United States Patent [19]

Merrifield

[11] Patent Number: 4,832,509

[45] Date of Patent: May 23, 1989

[54] DRAWER GUIDE STRUCTURE

[75] Inventor: Richard H. Merrifield, Montpelier, Ohio

[73] Assignee: Winzeler Stamping Company, Montpelier, Ohio

[21] Appl. No.: 227,491

[22] Filed: Aug. 1, 1988

Related U.S. Application Data

[63] Continuation of Ser. No. 88,405, Aug. 24, 1987, abandoned.

[51] Int. Cl.[4] ..... A47B 88/04; A47B 88/16

[52] U.S. Cl. ..... 384/21; 312/348; 384/20

[58] Field of Search ..... 384/17, 20–23; 312/341 R, 341 NR, 343, 344, 346, 347, 348

[56] References Cited

U.S. PATENT DOCUMENTS

| | | | |
|---|---|---|---|
| 2,559,322 | 7/1951 | Skanser | 312/346 |
| 2,699,370 | 1/1955 | Weiskopf | 312/346 |
| 2,865,684 | 12/1958 | Meyer et al. | 384/17 |
| 3,033,639 | 5/1962 | Emery | 312/348 |
| 3,185,530 | 5/1965 | Reiss, Sr. et al. . | |
| 3,211,510 | 10/1965 | Reiss, Sr. et al. | 312/346 |
| 3,363,960 | 1/1968 | Reiss et al. | 312/344 |
| 3,365,261 | 1/1968 | Gutner . | |
| 3,477,770 | 11/1969 | Niemi | 384/23 |
| 3,649,087 | 3/1972 | Thomas . | |
| 3,650,577 | 3/1972 | Gutner . | |
| 3,658,394 | 4/1972 | Gutner . | |
| 3,702,717 | 11/1972 | Gutner . | |
| 3,825,310 | 7/1974 | Roemer | 384/23 |
| 4,389,079 | 6/1983 | Cosme | 312/343 X |

*Primary Examiner*—Thomas R. Hannon
*Attorney, Agent, or Firm*—Marshall & Melhorn

[57] ABSTRACT

A drawer guide and track member with minimal frictional engagement thereof in which the guide member is formed a generally C-shaped cross sectional configuration adapted for to and from movement on a cooperating track member. The upper surface of the track member contains a longitudinally extending groove adapted to receive a downwardly projecting staked stop member formed into the guide member. The bearing surfaces of the guide member are formed to provide minimal frictional engagement between the guide member and the track member so as to reduce the overall friction during use of the drawer guide.

3 Claims, 2 Drawing Sheets

DRAWER GUIDE STRUCTURE

This application is a continuation of application Ser. No. 088405 filed Aug. 24, 1987, now abandoned.

BACKGROUND OF THE INVENTION

The present invention relates generally to a drawer guiding system and more particularly to a friction reducing drawer guide and safety stop construction.

The principal difficulty encountered in the manufacture and utilization of sliding drawers is the fact that such structures tend to become difficult to operate after prolonged use. Therefore, in the construction of furniture, it has become advantageous to mount a drawer upon a central guide which supports the drawer. An essential requirement of such a guide is that it permits the drawer to move smoothly with a minimal amount of friction, and that it also guides the drawer accurately so as to prevent displacement or misalignment. The displacement or misalignment of the drawer which causes bind on one side or the other are the principal causes for the drawer being difficult to operate after prolonged use. It can be appreciated that such breakdown in the drawer operation can result in inefficiency as well as inoperability of the drawer system.

Efforts have been made to facilitate the sliding movement and reduce friction of a mounted drawer by means of efficient, but economically exacting support and guide members. The most common method employed is the use of roller bearings, however these bearings are very expensive and in addition, are susceptible to mechanical breakdown and noise.

A further problem that has existed is that with the requirement for guiding the drawer accurately, and with minimal friction, it is difficult to provide a safety stop which prevents the drawer from being pulled accidentally all the way out, and yet provides for the drawer to be removed completely when desired.

With the above in mind, the primary objective of the present invention is to provide a drawer support and guide system adapted to reduce the effort required to move the drawer, and in addition provide a safety stop which prevents the drawer from being accidentally pulled out all the way, yet allows for removal when desired.

SUMMARY OF THE INVENTION

The present invention relates to a combination drawer guide and safety stop which provides noiseless, low friction operation of a drawer, and at the same time prevents the drawer from being accidentally pulled out all the way.

The present invention involves a guide member formed from a stip of stampled metal material having a generally C-shaped cross section configurtion adapted for a telescoping to and fro movement on a cooperating track member constructed of wood or other suitable material and having a generally T-shaped cross-section. The guide member being attached in suitable fashion to the bottom of a drawer.

The guide member is configured so as to have its side walls terminated in in-turned flanges, and also having a cavity in each of the side walls near the end of the guide member. The guide member is also configured to include an upraised channel longitudinally extending along the control portion thereof, and a downwardly staked stop member as a safety device. The upraised channel, and the cavities cooperate to reduce the frictional surface contact of the guide member and an associated track member.

The track member is configured, as aforementioned, to include a generally T-shaped cross section and is adapted to be fixed to an article of furniture. The upper surface of the track member is hollowed out in order to form a longitudinally extending groove adapted to receive the downward projecting staked stop member of the guide member. The track member may be typically attached to the article of furniture by means of threaded fasteners, for example. At least one of the fasteners is adapted to cooperate with the downwardly staked stop member of the guide member to provide a positive stop to prevent the drawer from being accidentally pulled out, and the fastener is also employed to attach the track member to the article of furniture.

The guide member incorporating the features of the invention cooperates with an associated track member to form a noiseless, now friction drawer guide system with a safety stop to prevent accidentally pulling the drawer completely out, and at the same time allow the drawer to be removed when required.

BRIEF DESCRIPTION OF THE DRAWINGS

The above objects and advantages of the invention will become manifest to one skilled in the art from considering the following detailed description of an embodiment of the invention in the light of the accompanying drawings, in which.

DESCRIPTION OF THE PREFERRED EMBODIMENT

Figure 1:
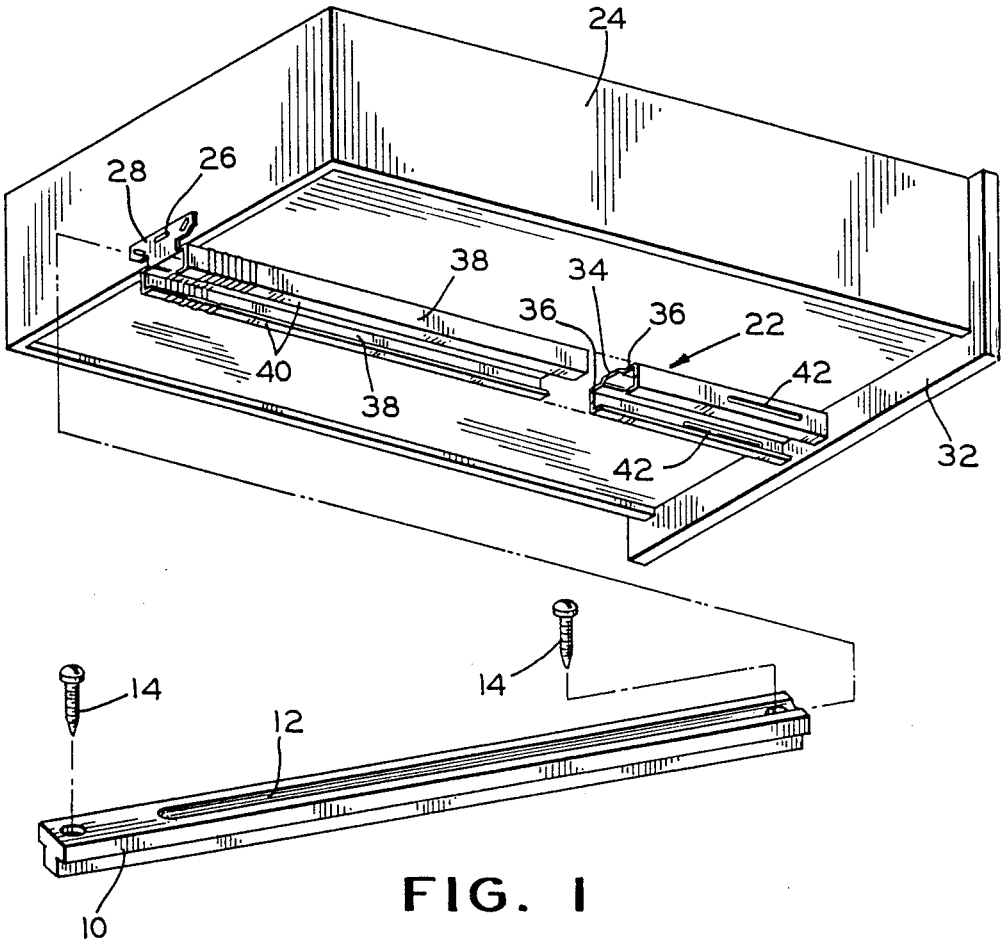
FIG. 1 is a perspective exploded view of a drawer assembly showing the guide member with portions broken away to more clearly illustrate the invention and an associated track member.

Referring to the drawings, there is illustrated a track member 10 adapated to be affixed to slidingly support a guide member 22 attached to an associated drawer 24. The upper surface of the track member 10 is provided with a longitudinal groove 12 which is adapted to extend from one end of the member 10 and terminate adjacent the opposite end thereof. Threaded fasteners 14 are employed to attach the track member 10 to the associated article of furniture. More specifically, one of the fasteners 14 is typically employed to secure the innermost end of the track member 10 to a support member 16 which may be glued or otherwise suitably secured to the inner surface of an outer panel 18 of the associated article of furniture, which may be a desk, chest of drawers, dressing table, or the like. The opposite or outer end of the track member 10 is secured to a horizontally extending cross member 20 of the article of furniture by the other of the fasteners 14, as clearly illustrated in FIGS. 2 and 3. The head of the fastener 14 employed for securing the outer end of the track 10 is adapted to be disposed within the groove 12 in such a fashion that the head thereof is adapted to project upwardly from the base of the groove 12.

Figure 2:
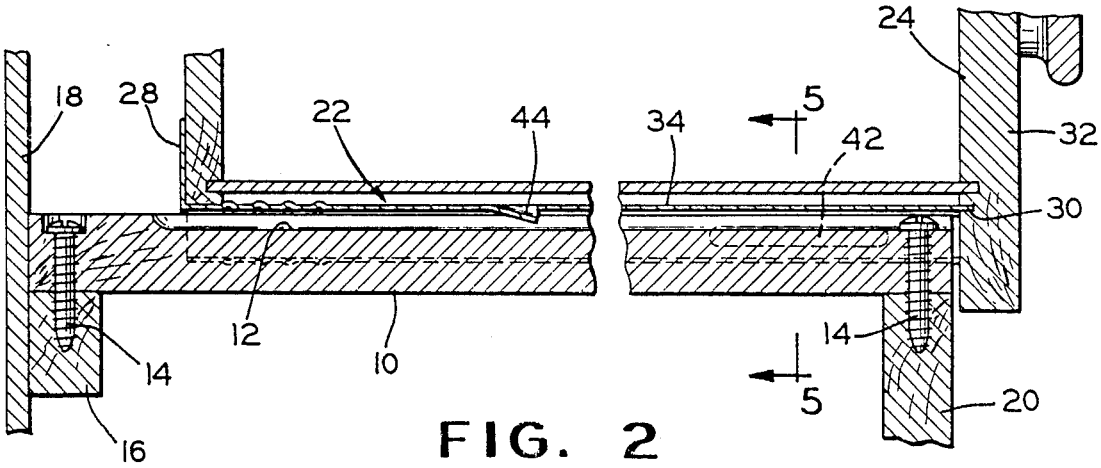
FIG. 2 is a fragmentary longitudinal vertical section of the drawer guide, the associated drawer, and track member illustrated in FIG. 1 in a combined operative relation.
Figure 3:
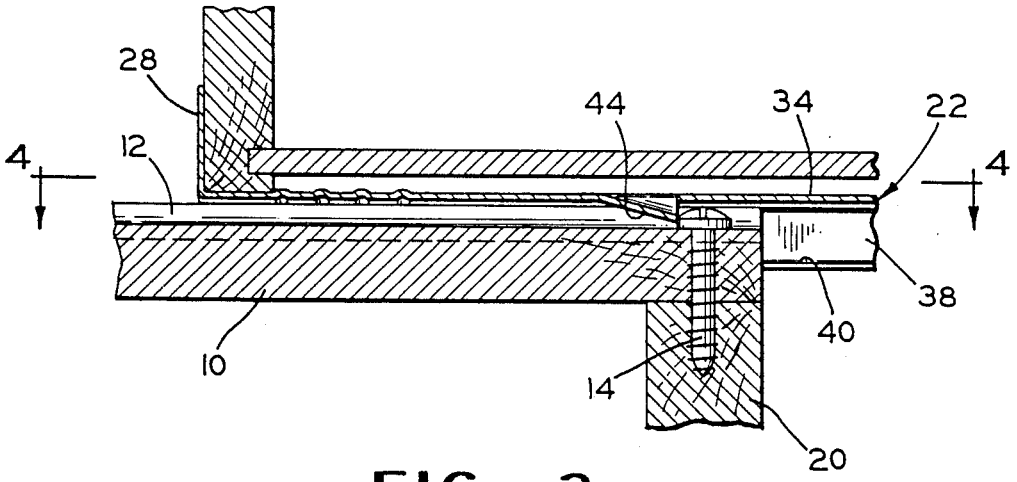
FIG. 3 is a fragmentary sectional view similar to FIG. 2 with the drawer in an open position.
Figure 4:
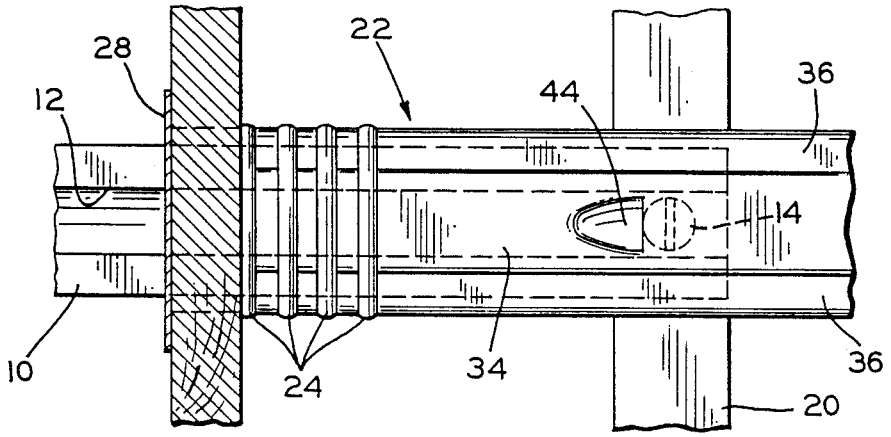
FIG. 4 is a sectional view taken along line 4—4 of FIG. 3.
Figure 5:
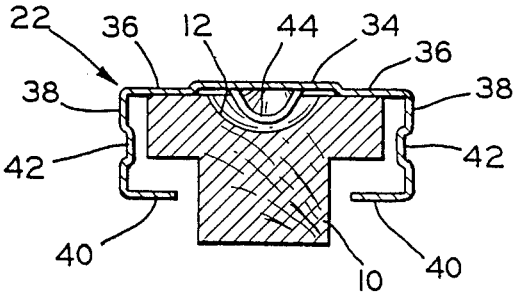
FIG. 5 is a sectional view taken along line 5—5 of FIG. 2.

A guide member 22 incorporating the features of the invention is adapted to be secured to the innermost end of the bottom of an associated drawer 24 by means of fasteners such as staples, for example, which are adapted to extend through suitably arranged slots in an upturned flange 28. A tab member 30 is provided to extend from the opposite end of the guide member 22 and is typically secured to the front panel 32 of the drawer 24, by means of fasteners or staples or may extend into an associated groove provided on the inwardly facing surface of the front panel 32, as illustrated in FIG. 2.

The guide member 22 is typically formed from strip metal stock and is provided with a longitudinally extending planar central portion 34. Extending in opposite directions from the longitudinal edges of the central portion 34 are lands 36 formed in a single plane spaced from the plane of the central portion 34.

Extending at generally right angles to the plane of the lands 36 from the outer edges thereof are side walls 38 which are formed to terminate in inwardly extending flanges 40.

A generally horizontally disposed inwardly extending rib 42 is formed to extend inwardly from each of the depending side walls 38 generally in the region of the end of the guide member 22 containing the tab 30.

The central or web portion 34 of the guide member 22 is further provided with a downwardly projecting staked stop member 44.

The guide member 22 is further provided with a plurality of strengthening rib members 24 formed adjacent the end thereof containing the upstanding flange and function to increase the bending resistance thereof.

In operation, the track member 10 and the guide member 22 are joined in telescopic relation such that the track member 10 telescopes within the channel formed by the guide member 22 as is illustrated in FIGS. 2, 3, 4, and 5 of the drawings. It will be appreciated that as to and fro movement of the drawer 24 and the associated guide 22 with respect to the track member 10 takes place, frictional engagement occurs between the facing surfaces of the lands 36 and the upper faces of the track member 10 which extend outwardly from the upper edges of the groove 12. The inwardly extending grooves 42 function to minimize misalignment of the drawer 24 when in a closed position. It will be noted that canting of the drawer 24 can be limited by contact of the inner surface of one the grooves 42 and the adjacent outer surface of the track member 10.

The staked stop member 44 of the guide member 22 is adapted to travel within the longitiudinally extending groove 12 of the track member 10 during normal to and fro movement of the drawer 24 relative to the track member 10. The staked stop member 44 is adapted to cooperate with the head of the outermost threaded fastener 14 exposed within the outermost end of the groove 12. When the drawer 24 is pulled out to the limit of the travel thereof, the staked stop member 44 contacts the head of the threaded fastener 14 to militate against any further relative movement thereof and prevents the drawer 24 from accidentally being removed from the guide assembly. In the event that is is desired to remove the drawer 24, the rear end of the drawer 24 is lifted to permit the staked stop member 44 to clear the head of the threaded fastener 14 and completely traverse the same.

While the preferred embodiment of the invention has employed wood for the formation of the track member 10, and sheet metal for the formation of the guide member 22, it will be understood that other materials may be advantageously employed in such construction.

In accordance with the provision of the patent statues, the principle and mode of operation of the present invention have been illustrated and described in what is considered to understood that the present invention can be practiced otherwise than is specifically illustrated and described without departing from the scope of the invention.

What is claimed is:

1. In combination with an article of furniture having a drawer and a drawer compartment adapted to receive the drawer, the drawer having a horizontally disposed bottom portion, the improvement comprising:

a track member adapted to be secured to the article of furniture within the drawer compartment and having an upwardly facing surface for supporting the drawer, an elongated groove in said track member extending longitudinally along said upwardly facing surface, said groove being of arcuate configuration in cross section;

a guide member adapted to be secured to the bottom of the drawer for to and fro movement on said track member, said guide member having an elongate central portion disposed at least in one plane and having oppositely extending lands extending along a portion of the central portion and residing in a plane spaced from the central portion and adapted to bear against the upwardly facing structure of said track member on either side of said groove, the lands terminating in downwardly depending means for partially enveloping said track member to limit relative transverse movement of said guide member relative to said track member, and an outwardly projecting staked stop member, said stop member including an exposed face lying generally in a plane extending normal to the longitudinal axis of said guide member, said exposed face having a configuration generally complementary to said arcuate configuration of said groove and being adaped for movement along and within said groove as said guide member moves to and fro on said track member; and a headed fastener located within said groove for attaching said track member to the article of furniture, the head of said fastener projecting into said groove and being positioned to engage said exposed face of said stop member and thereby provide a positive stop for said drawer.

2. The invention defined in claim 1 wherein said track member is constructed of wood.

3. The invention defined in claim 1 wherein said guide member is constructed from a stip of stamped metal material.

* * * * *